United States Patent [19]

Yamada et al.

[11] Patent Number: 4,672,025

[45] Date of Patent: Jun. 9, 1987

[54] METHOD FOR PROCESSING SILVER HALIDE PHOTOGRAPHIC MATERIAL

[75] Inventors: Minoru Yamada; Takashi Toyoda, both of Kanagawa, Japan

[73] Assignee: Fuji Photo Film Co., Ltd., Kanagawa, Japan

[21] Appl. No.: 760,436

[22] Filed: Jul. 30, 1985

[30] Foreign Application Priority Data

Jul. 30, 1984 [JP] Japan ..... 59-159946

[51] Int. Cl.[4] ..... G03C 5/30; G03C 5/38

[52] U.S. Cl. ..... 430/420; 430/489; 430/491; 430/966

[58] Field of Search ..... 430/420, 491, 966, 967, 430/489

[56] References Cited

U.S. PATENT DOCUMENTS

| | | | |
|---|---|---|---|
| 3,201,246 | 8/1965 | Allen et al. | 430/491 |
| 3,811,888 | 5/1974 | Shibaoka et al. | 430/491 |
| 3,994,729 | 11/1976 | Shibaoka | 430/420 |
| 4,040,833 | 8/1977 | Hinata et al. | 430/966 |

FOREIGN PATENT DOCUMENTS

| | | |
|---|---|---|
| 1408376 | 10/1975 | United Kingdom . |
| 1429919 | 3/1976 | United Kingdom . |

OTHER PUBLICATIONS

Purol et al., "Use of Sequestering Agents . . . ", *Research Disclosure,* No. 18837, 12/1979, pp. 692 & 693.

*Primary Examiner*—Richard C. Schilling

*Attorney, Agent, or Firm*—Sughrue, Mion, Zinn, Macpeak & Seas

[57] ABSTRACT

A silver halide photographic material is developed with an alkaline black-and-white developer comprising (1) hydroquinone, (2) a 3-pyrazolidone-type developing agent, (3) a dialdehyde-type hardener, (4) at least one antifoggant selected from the group consisting of indazole-type antifoggants, benzimidazole-type antifoggants and benzotriazole-type antifoggants, and (5) at least one chelating agent selected from the group consisting of diethylenetriaminepentaacetic acid, triethylenetetraminehexaacetic acid, 1,3-diamino-2-propanoltetraacetic acid, glycol ether diaminetetraacetic acid, ethylenediaminetetramethylenephosphonic acid, aminotrimethylenephosphonic acid and alkali metal salts of said acids.

8 Claims, No Drawings

METHOD FOR PROCESSING SILVER HALIDE PHOTOGRAPHIC MATERIAL

FIELD OF THE INVENTION

This invention relates to a photographic processing liquid for silver halide photographic materials, and more specifically, to a method for processing radiographic silver halide photographic materials in an automatic processor with markedly increased stability.

BACKGROUND OF THE INVENTION

Black-and-white developers for silver halide photographic materials generally contain dihydroxybenzenes (particularly, hydroquinone), 3-pyrazolidones, alkaline agents and sulfites as basic constituents.

It is common knowledge in the art that when photographic materials are to be processed in an automatic processor of the type generally used in recent years in the development of radiographic silver halide photographic materials, a dialdehyde-type hardener is added in order to reinforce the mechanical strength of the emulsion film of the photographic materials. Details of the are described, for example, in U.S. Pat No. Re. 26,601, U.S. Pat. No. 3,545,971, and British Pat. No. 1,269,268. It is well known in the art, as also described in the specifications of the above-cited patents, that since the use of dialdehyde-type hardeners in developers causes inherently high fogging by these compounds, it is absolutely necessary to add organic antifoggants which specifically inhibit this fogging, for example, indazole-type compounds, benzotriazole-type compounds, benzimidazole-type compounds, anthraquinonesulfonic acid-type compounds, mercaptotetrazole-type compounds and thiadiazole-type compounds.

Many organic antifoggants which specifically inhibit the fogging caused of the dialdehyde-type hardeners are known, and examples include 5-nitroindazole,
5-p-nitrobenzoylaminoindazole,
1-methyl-5-nitroindazole,
6-nitroindazole,
3-methyl-5-nitroindazole,
5-nitrobenzimidazole,
2-isopropyl-5-nitrobenzimidazole,
5-nitrobenzotriazole,
2-thiazolylmethylbenzimidazole,
hydroxyazaindolidine,
1-phenyl-5-mercaptotetrazole,
2-mercaptobenzothiazole,
thiosalicyclic acid,
benzothiazole,
sodium 1-anthraquinonesulfonate,
sodium 2-anthraquinonesulfonate,
thiazole,
1-(N,N-diethylamino)ethylmercaptotetrazole,
sodium 4-(2-mercapto-1,3,4-thiadiazol-2-yl-thio)butanesulfonate,
5-amino-1,3,4-thiadiazole-2-thiol,
2-(2,4-dinitrophenylmercapto)benzothiazole, and
3-ethyl-5-o-nitrobenzylidene-1-phenyl-2-thiohydantoin.

It is the general practice nowadays to subject a radiographic silver halide photographic material to a rapid processing treatment in an automatic processor, e.g., for 3.5 minutes or 90 seconds, and a so-called PQ developer comprising a combination of hydroquinone and 3-pyrazolidone-type developing agents is frequently used in order to increase developing activity.

In the development of silver halide photographic materials, calcium ions often get into the developer. It is considered to be derived from water used and from the silver halide/gelatin emulsion. Calcium ions react with carbonates and sulfites in the developer to form a precipitate of calcium carbonate and calcium sulfite. Such a precipitate is undesirable because it causes the formation of a sludge in the developer solution, a scum on the photographic material and a deposit on the developer tank.

Attention has long been paid to a method of remedying the undesirable development caused by such precipitates, and attempts have been made to prevent the formation of such precipitates by using compounds which can convert the calcium ion in the developer solution into the form of a soluble complex.

Alkali metal salts of hexametaphosphoric acid, and polyphosphoric acid salts such as alkali metal salts of tetraphosphoric acid are compounds which are characteristic in the above sense. These compounds are known to prevent precipitation of calcium salts in the developer. However, these compounds tend to undergo hydrolysis to orthophosphoric acid in the developer. Orthophosphoric acid no longer has the property of hiding the calcium ion, and rather becomes a cause of formation of calcium phosphate. When an orthophosphoric acid salt is carried into a fixing bath containing aluminum ions, such as an ordinary acidic hardening-fixing bath, aluminum phosphate may be undesirably precipitated.

Organic acids such as citric acid, tartaric acid and gluconic acid have the ability of a calcium masking agent, but in most cases, have a lower masking power than polyphosphates.

Compounds such as ethylenediaminetetraacetic acid (EDTA) and nitrilotriacetic acid (NTA) have long been known, and have proved to be satisfactory in respect of stability in developers and a masking effect. However, if a trace of an iron or copper salt exists together in the developer, such a compound forms an iron chelate compound or a copper chelate compound which acts catalytically to undesirably promote the air oxidation (autoxidation) of the hydroquinone developing agent. For example, when EDTA is added to a developer containing several ppm of iron, the air oxidation of the developing agent occurs at a speed more than 3 times as fast as that at which it occurs in the absence of EDTA. At the same time, in the presence of EDTA, the pH of the developer increases and adversely affects the stability of the developer with time.

The applicability of other various chelating agents to black-and-white developers (for example, the PQ developer) for general silver halide photographic materials is described in L. F. A. Mason, *Photographic Processing Chemistry* (1975, Focal Press, London), or *Research Disclosure* RD Nos. 18837 (December, 1979) and 20405 (April, 1981).

Thus, although many compounds have been suggested as a calcium masking agent for use in photographic processing liquids, they have only weak efficacy or secondary defects and are not entirely satisfactory. Even EDTA now is widespread use has the aforesaid serious defect. If this defect could be overcome, the developing operation would be able to be performed continously over long periods of time with good stability and high quality.

SUMMARY OF THE INVENTION

A primary object of this invention is to provide a developer for processing a silver halide photographic material, which is stable over long periods of time and can provide excellent photographic properties.

A secondary object of this invention is to provide a developer for processing a silver halide photographic material which maintains the emulsion film strength and the drying speed during the development at high levels.

Another object of this invention is to provide a developer for processing a silver halide photographic material, which alleviates the burden of a processing operation.

The developer according to this invention is especially useful for processing a radiographic silver halide photographic material.

The above objects are achieved by developing a silver halide photographic material with an alkaline black-and-white developer comprising (1) hydroquinone, (2) a 3-pyrazolidone-type developing agent, (3) a dialdehyde-type hardener, (4) at least one antifoggant selected from the group consisting of indazole-type antifoggants, benzimidazole-type antifoggants and benzotriazole-type antifoggants, and (5) at least one chelating agent selected from the group consisting of diethylenetriaminepentaacetic acid, triethylenetetraminehexaacetic acid, 1,3-diamino-2-propanoltetraacetic acid, glycol ether diaminetetraacetic acid, ethylenediaminetetramethylenephosphonic acid, aminotrimethylenephosphonic acid and alkali metal salts of said acids.

DETAILED DESCRIPTION OF THE INVENTION

It was unexpected that the aforesaid objects could be achieved only by using a combination of the aforesaid limited compounds.

It has also been found that to increase the stability of the developer further (namely, to inhibit a reduction in sensitivity and a decrease in contrast), it is desirable to adjust the molar ratio of the sulfite and bisulfite (i.e., the combined total amounts) to hydroquinone to a point above a certain limit. Specifically, the molar ratio of the sulfite and bisulfite to hydroquinone is preferably at least about 1.6/1, more preferably from about 1.6/1 to about 3.5/1, and especially preferably from about 1.65/1 to about 2.8/1.

Investigations of the present inventors have unexpectedly shown that in a developer for an automatic processor containing a dialdehyde-type hardener (necessary in combination with an organic antifoggant), the photographic properties of a photographic material to be processed depend upon the very complex interaction among the dialdehyde-type hardener, the sulfite or bisulfite contained as a preservative, hydroquinone, the organic antifoggant, and the pH of the developer, and the mere choice of a chelating agent which increases the stability of the developing agent is not sufficient. In other words, it has been found that to maintain the developer stability over a long period of time, and secure excellent photographic properties, not only is the choice of a chelating agent which increases the stability of the developing agent in the above developer system required, but also a special technique is required for adapting it to the other developer components.

For example, in order for the developer to have activity which leads to sufficient photographic properties, it is especially desirable that hydroquinone should be present in amounts above a certain limit, and a corresponding amount of a sulfite or bisulfite should be present in the developer. In other words, the sulfite or bisulfite not only acts as a stabilizer or preservative against oxidation of hydroquinone, but also is an essential component which makes the hydroquinone exhibit development activity.

Since the dialdehyde-type hardener forms an adduct with the bisulfite in a certain fixed ratio, the hardening reaction activity varies depending upon the amount of the bisulfite even when the amount of the dialdehyde-type hardener is the same. Furthermore, the amount of the sulfite or bisulfite has been found to have great significance, because the hardening reaction activity is controlled mainly by the amount of the dialdehyde-type hardener, the amount of the bisulfite, and even the pH changes the photographic characteristics, particularly $D_{max}$ and $\overline{G}$ (gradation).

Ethylenediaminetetraacetic acid, which has most generally been used heretofore as a chelating agent, has its own important characteristics such as an ability to chelate calcium, stability, reasonable cost, solubility, etc. In addition, ethylenediaminetetraacetic acid has also been found to be effective for stabilizing the sulfite, as described at pages 232–265 of A. G. Tull, *Brit. J. Photo.*, 19, (March, 1976). In practice, however, ethylenediaminetetraacetic acid has the defect that when it is used in a developer, the insufficient stability of hydroquinone causes a decrease in the amount of the sulfite, increases the pH and degrades the dialdehyde-type hardener, and the photographic characteristics shown by a fresh developer are retained only for a short period of time.

Various chelating agents replacing EDTA have been proposed as stated above. They have been effective merely for increasing the stability of hydroquinone. However, the stability of photographic properties determined by complex factors involving the composition of the developer as stated above has not been able to be improved by simply replacing the chelating agent.

It has now been found in accordance with this invention that the chelating agent not only acts as an inherent chelating agent for calcium and as a stabilizer against the oxidation of hydroquinone as a subsidiary effect, but also exerts an important effect on the stability of the organic antifoggant used in the developer of this invention. In other words, the present inventors have found that though when the dialdehyde-type hardener is used, it is essential to use a specific organic antifoggant, there is also present in this system a specific combination with a specified chelating agent. The mechanism, however, has not yet been elucidated. It has further been found that by adjusting the molar ratio of the sulfite and bisulfite to hydroquinone to at least about 1.6/1, it is easier to maintain the photographic properties stable over a long period of time by using the chelating agent in accordance with this invention. The developer in accordance with this invention changes less toward a light to blackish brown color as a result of its oxidative degradation even after it has been used for processing over long periods of time.

The chelating agent in accordance with this invention has the sufficient ability to mask (chelate) not only a calcium ion but also heavy metal ions such as an iron ion. Furthermore, it significantly increases the stability of a developer containing hydroquinone, a dialdehyde-type hardener, etc. and markedly stabilizes the pH of the developer.

The chelating agent in accordance with this invention is stable over a long period of time in an alkaline solution such as a developer solution having a high pH and is easy to synthesize or obtain at low costs from the market.

The addition of such a chelating agent in accordance with this invention prevents the precipitation of an insoluble calcium salt, and causes of the formation of sludges, scums, etc. can be removed. Conveniently and very preferably, the amount of the chelating agent in accordance with this invention is about from $1\times10^{-3}$ to $1\times10^{-2}$ mole per liter of the processing liquid. The suitable amount of the chelating agent depends upon the properties of the processing liquid. For example, it must be added in a higher concentration to a developer containing a phosphate salt. It also depends upon the quality of water used in processing, and for hard water, the amount is increased according to its hardness.

From the standpoint of the stability of the developer over a long period of time, etc., the aminopolycarboxylic acids or organic phosphonic acids used in the developer of this invention are preferably diethylenetriaminepentaacetic acid, triethylenetetraminehexaacetic acid, ethylenediaminetetramethylenephosphonic acid, glycol ether diaminetetraacetic acid, 1,3-diamino-2-propanoltetraacetic acid and eminotrimethylenephosphonic acid, and alkali metal salts of these acids. Diethylenetriaminepentaacetic acid, triethylenetetraminehexaacetic acid, ethylenediaminetetramethylenephosphonic acid and alkali metal salts of these acid are especially preferred.

Examples of the 3-pyrazolidone-type developing agent include 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolide, 1-phenyl-4-methyl-4-hydroxymethyl-3-pyrazolidone, and 1-phenyl-4,4-dihydroxymethyl-3-pyrazolidone.

Hydroquinone is used in a concentration of usually from 10 g to 50 g/liter, and preferably 15 g to 35 g/liter. The concentration of the 3-pyrazolidone-type developing agent used in usually from 0.3 g to 3 g/liter, and preferably from 0.5 g to 2 g/liter. 1-Phenyl-3-pyrazolindone is especially preferred as the developing agent because of its high developing activity.

The dialdehyde-type hardener or its bisulfite adduct is used in the developer as stated above. Examples of such hardeners include glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-ethoxyglutaraldehyde, α-n-butoxyglutaraldehyde, α,α-dimethoxysuccinic dialdehyde, β-isopropylsuccinic dialdehyde, α,α-diethylsuccinic dialdehyde, butylmaleic dialdehyde, and bisulfite adducts of these aldehydes. The dialdehyde-type hardener is used in amounts which do not inhibit the sensitivity of the photographic layer to be treated and do not make the drying time very long. Specifically, it is used, for example, in an amount of from 1 to 50 g, and preferably from 3 g to 10 g, per liter of the developer. Among the above dialdehydes, glutaraldehyde and its bisulfite adducts are most generally used.

Examples of the antifoggant of the indazole, benzimidazole or benzotriazole type include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-(2-mercapto-1,3,4-thiadiazol-2-yl-thio)butanesulfonate and 5-amino-1,3,4-thiadiazole-2-thiol.

Antifoggants including a nitro group are especially preferred.

Among the above antifoggants, 5-nitroindazole, 5-nitrobenzimidazole, and 5-nitrobenzotriazole are preferred. From the standpoint of safety, 5-nitroindazole is especially preferred.

The amount of the antifoggant included in the developer of this invention is usually from 0.01 to 10 mmoles, and preferably from 0.1 to 2 mmoles, per liter of the developer.

Specific examples of the sulfite or bisulfite used in this invention are sodium sulfite, potassium sulfite, sodium bisulfite, and potassium bisulfite, and metabisulfites such as sodium metabisulfite and potassium metabisulfite.

Since 1 mole of a metabisulfite forms 2 moles of a bisulfite in aqueous solution, it is regarded as 2 moles of the bisulfite for purposes of this invention.

The content of the sulfite and bisulfite is preferably from 0.15 to 0.8 mole, more preferably 0.225 mole to 0.65 mole, per liter of the developer.

Various organic or inorganic chelating agents may be used in the developer of this invwention in combination with the chelating agent specified in this invention.

Sodium tetrapolyphosphate and sodium hexametaphosphate are examples of the inorganic chelating agents, and organic carboxylic acids, aminopolycarboxylic acids, organic phosphonic acids, aminophosphonic acids and organic phosphonocarboxylic acids are examples of the organic chelating agents.

Examples of the organic carboxylic acids include acrylic acid, oxalic acid, malonic acid, succinic acid, glutaric acid, adipic acid, pimelic acid, cork acid, azelaic acid, sebacic acid, nonanedicarboxylic acid, decanedicarboxylic acid, undecanedicarboxylic acid, maleic acid, itaconic acid, malic acid, citric acid, and tartaric acid. These are not limitative, however.

Examples of the aminopolycarboxylic acids are iminodiacetic acid, nitrilotriacetic acid, nitrilotripropionic acid, ethylenediaminemonohydroxyethyltriacetic acid, ethylenediaminetetraacetic acid, glycol ether diaminetetraacetic acid, hydroxyethyliminodiacetic acid, diaminopropanoltetraacetic acid, 1,2-diaminopropanetetraacetic acid, and the compounds described in Japanese Patent Application (OPI) Nos. 25632/1977, 67747/1980 and 102624/1982 (the term "OPI" as used herein refers to a "published unexamined Japanese patent application"), and Japanese Patent Publication No. 40900/1978.

The hydroxyalkylidene-diphosphonic acids described in U.S. Pat. Nos. 3,214,454 and 3,794,591 and West German OLS No. 2227639, and the compounds described in *Research Disclosure,* RD. No. 18170 (May, 1979) are known as organic phosphonic acids.

Amino-tris(methylenephosphonic acid) is known as the aminophosphonic acid. Other examples include the compounds described in *Research Disclosure,* RD. No. 18170 (May, 1979), and Japanese Patent Application (OPI) Nos. 208554/1972, 61125/1979, 29883/1980, and 97347/1981.

Examples of the organic phosphonocarboxylic acids include the compounds described in Japanese Patent Application (OPI) Nos. 102726/1977, 42730/1978, 121127/1979, 4024/1980, 4025/1980, 126241/1980, 65955/1980, and 65956/1980, and *Research Disclosure,* RD No. 18170 (May, 1979).

These chelating agents may be used in the form of alkali metal salts or ammonium salts.

The amount of the additional chelating agent used as the total amount including the chelating agent specified in this invention is preferably from $1\times10^{-4}$ to $1\times10^{-1}$ mole, and more preferably $1\times10^{-3}$ to $1\times10^{-2}$ mole, per liter of the developer.

If desired, the developer in accordance with this invention may further include a buffer (such as a carbonate, boric acid, borate salts, or alkanolamines), an alkaline agent (such as hydroxides or carbonates), a dissolving aid (such as polyethylene glycols or their esters), a pH adjusting agent (for example, organic acids such as acetic acid), a development accelerator or a surface active agent. Useful development accelerators are, for example, various pyrimidium compounds or other cationic compounds, cationic dyes such as phenosafranine, and neutral salts such as thallium nitrate or potassium nitrate which are typically exemplified by U.S. Pat. Nos. 2,648,604 and 3,171,247 and Japanese Patent Publication No. 9503/1969; the polyethylene glycol or its derivatives and nonionic compounds such as polythioethers which are described in Japanese Patent Publication No. 9304/1969 and U.S. Pat. Nos. 2,533,990, 2,531,832, 2,950,970 and 2,577,127; and the organic solvents described in Japanese Patent Publication No. 9509/1969 and Belgian Pat. No. 682862. The thioether compounds described in U.S. Pat. No. 3,201,242 can also be used. Of these, the thioether-type compounds are preferred.

The developer may further include a dispersing agent (such as a mercapto compound) for eluted silver colloids, and an antifoggant (halogen compounds such as potassium bromide or sodium bromide, the aforesaid organic antifoggants, and other known antifoggants).

The developer in accordance with this invention has a pH, preferably, from 9 to 13, and more preferably from 9 to 12.

The processing temperature and time have to do with each other, and are determined in relation to the total processing time. Generally, the processing temperature is from about 20° to about 50° C., and the processing time is from 10 seconds to 3 minutes.

The fixing solution is an aqueous solution containing a thiosulfate, and, if desired, a water-soluble aluminum compound and tartaric acid, citric acid, gluconic acid, boric acid, or a salt thereof, and desirably has a pH of from about 3.8 to about 7.0 (at 20° C.). In the method of this invention a stopping step may be provided after the development. However, generally, the stopping stepo is omitted in a roller conveying-type automatic processor. Hence, the developer is carried over to the fixing solution, and the pH of the fixing solution rises. When the fixing solution contains an aluminum compound, the pH of the fixing solution is desirably adjusted to from about 3.8 to 5.0 (20° C.) in order to maintain high reactivity of the aluminum compound.

The fixing agent contains a thiosulfate ion and ammonium ion as essential components for example ammonium thiosulfate, etc. The use of ammonium thiosulfate is especially preferred in view of the speed of fixing. The amount of the fixing agent can be varied, and is generally about 0.1 to about 5 moles/liter.

The water-soluble aluminum salt acting mainly as a hardener in the fixing solution is a compound generally known as a hardener in an acidic hardening fixing solution, and includes., for example, aluminum chloride, aluminum sulfate, and potassium alum.

Tartaric acid or its derivatives and citric acid or its derivatives may be used singly or in combination. The effective amount of these compounds is at least 0.005 mole, particularly 0.015 mole to 0.05 mole, per liter of the fixing solution.

As desired, the fixing solution may contain a preservative (such as sulfites or bisulfites), a pH buffer (such as boric acid or boric acid salts), a pH adjusting agent (such as acetic acid), and a chelating agent (described hereinabove).

The fixing temperature and time are similar to the processing temperature and time, and are preferably about 20° to about 50° C., and 10 seconds to 3 minutes, respectively.

The photographic material developed and fixed as above is then washed with water, and dried. Washing is carried out in order to remove the silver salt dissolved by the fixation almost completely. It is preferably carried out at about 20° to about 50° C. for 10 seconds to 3 minutes. The drying is carried out at about 40 to about 100° C. The drying time can be properly varied depending upon the condition of the environment, but usually, it is about 5 seconds to 3.5 minutes.

A silver halide photographic material which can be applied to the method of this invention is composed of a support and at least one silver halide emulsion layer coated thereon. The silver halide emulsion layer may be coated on both surfaces of the support. Needless to say, the photographic material may have a backing layer, an antihalation layer, an interlayer, an uppermost layer (such as a protective layer), etc. as required.

The silver halide emulsion is a dispersion of a silver halide such as silver chloride silver iodide, silver bromide, silver chlorobromide, silver iodobromide or silver chloroiodobromide in a hydrophilic colloid (such as gelatin, modified gelatin, colloidal albumin, casein, carboxymethyl cellulose, hydroxyethyl cellulose, sodium alginate, polyvinyl alcohol, and polyvinyl pyrrolidone, either alone or as a mixture). It is produced by mixing a water-soluble silver salt (such as silver nitrate) and a water-soluble halide in the presence of water and the hydrophilic colloid by a method well known in the art (such as a single jet method, a double jet method, a controlled jet method, etc.) and subjecting the mixture to physical ripening and chemical ripening such as gold sensitization and/or sulfur sensitization. The emulsion thus obtained generally contains cubic, octahedral, and/or spherical silver halide grains. Tabular silver halide grains having a high aspect ratio, as described in *Reasearch Disclosure, RD. No.* 22534 (January, 1983), can also be used. The combination of internal latent image-type silver halide grains and surface latent image-type silver halide grains, described in Japanese Patent Publication No. 2068/1966, is also useful.

During the production of the silver halide emulsion or immediately before its coating, a spectral sensitizer (such as a cyanine dye, a merocyanine dye, or a mixture thereof), a stabilizer (such as 4-hydroxy-6-methyl-1,3,3a,7-tetrazaindene), a sensitizer (such as the compounds described in U.S. Pat. No. 3,619,198), an antifoggant (such as benzotriazole, 5-nitrobenzimidazole, or polyethylene oxide), a hardener (such as formaldehyde, glyoxal, mucochloric acid, or 2-hydroxy-4,6-dichlorostriazine), a coating aid (such as sponin, sodium lauryl sulfate, dodecyl phenol polyethylene oxide ether or hexadecyl trimethylammonium bromide), etc., may be added to it.

The silver halide emulsion thus prepared is coated on a support such as a cellulose acetate film or a polyethylene terephthalate film by a dipping method, an air knife method, an extrusion doctor method, a both surface coating method, etc., and then dried.

The silver halide photographic material exemplified above has varying silver halide compositions, additives and supports depending upon its use. Photographic materials to which the method of this invention is applied mainly include medical or industrial radiographic materials, and photographic materials for medical CRT (cothode ray tube) imaging.

The processing of the imagewise exposed photograhic material in the method of this invention is usually based on the following steps.

(1) Development-fixation-washing-drying (2) Development-stopping-fixation-washing-drying By using the specific developer in accordance with this invention, excellent photographic properties can be obtained stably over long periods of time.

The use of the developer in accordance with this invention can increase the strength of the emulsion film, particularly during processing. As a result, the drying speed can be maintained at a high level.

Furthermore, the tendency of the silver image to assume a reddish color with a degradation in the developer can be eliminated, and a silver image of a pure black tone can be obtained.

By adjusting the molar ratio of the sulfite and bisulfite to hydroquinone in the developer to at least about 1.6/1, further improvements can be achieved in the inhibition of sensitivity decrease and contrast reduction and in the prevention of coloration of the developer.

The following Examples illustrate the method of this invention more specifically. It should be understood, however, that the invention is in no way limited to these examples.

EXAMPLE 1

Developers 1 to 18 having the compositions shown in Table 1 for radiographic silver halide photographic materials were prepared.

TABLE 1

| | Developer | |
|---|---|---|
| | Nos. 1–9 | Nos. 10–18 |
| Chelating agent (see Table 2) | $3 \times 10^{-3}$ mol | $3 \times 10^{-3}$ mol |
| Potassium hydroxide | 29.0 g | 29.0 g |
| Potassium sulfite | 44.2 g | 54.2 g |
| Potassium metabisulfate | 12.6 g | 12.6 g |

TABLE 1-continued

| | Developer | |
|---|---|---|
| | Nos. 1–9 | Nos. 10–18 |
| Sodium bicarbonate | 7.5 g | 7.5 g |
| Boric acid | 1 g | 1 g |
| Diethylene glycol | 20 ml | 20 ml |
| 5-Methylbenzotriazole | 0.06 g | 0.06 g |
| 5-Nitroindazole | 0.2 g | 0.2 g |
| Hydroquinone | 30 g | 30 g |
| 1-Phenyl-3-pyrazolidone | 1.5 g | 1.5 g |
| Glutaraldehyde | 5 g | 5 g |
| Potassium bromide | 5 g | 5 g |
| Acetic acid to adjust | pH to 10.20 | pH to 10.20 |
| Water to make | 1 l | 1 l |
| molar ratio of (sulfite + bisulfite) to hydroquinone | 1.51 | 1.74 |

Five hundred milliliters of each of the developers was placed in a 500 ml beaker, and the beaker was covered with a plastic wrapping film. A hole, 1 cm in diameter, was formed in the cover film, and the beaker was left to stand at 30° C. for 12 days. Then, the main components of the developer were analyzed and determined.

A radiographic material composed of a polyethylene terephthalate film and on both surfaces thereof, a silver iodobromide gelatin emulsion layer (2 mole % of silver iodide, 70 g/mole Ag of gelatin) coated at a rate of 4 g/m$^2$ as silver and a gelating protective layer coated at a rate of 1 g/m$^2$ as gelatin was subjected to the following clip-type hanger development in the above developer left to stand for 12 days at 30° C.

| Processing step | | |
|---|---|---|
| Development | 35° C. | 25 seconds |
| Fixation | 33° C. | 25 seconds |
| Washing | 20° C. | 30 seconds |
| Drying | 55° C. | 20 seconds |

Fuji F (make by Fuji Photo Film Co., Ltd.) was used for the fixation.

To examine the ability to chelate $Ca^{++}$, $CaCl_2$ was added to each of the above developers so that the concentration of $Ca^{++}$ became 100 ppm, and the state of formation of a precipitate was observed.

The results are summarized in Tables 2 and 3.

The relative sensitivity was determined by using "fog+1.0" as a standard point. The sensitivity is indicated as a relative value by taking the sensitivity obtained with the so-prepared developer as 100.

The chelating ability is evaluated by "X" which shows the formation of a precipitate, and "o" which shows no formation of a precipitate.

TABLE 2

| Developer | 1 | 2 | 3 | 4 | 5 | 6 | 7 | 8 | 9 |
|---|---|---|---|---|---|---|---|---|---|
| Chelating agent | — | EDTA | EDTA—OH | PBTC | SSA | DTPA | TTHA | EDTP | TTHA EDTA |
| Amount of remaining hydroquinone (g/l) | 8.1 | 1.3 | 4.2 | 8.9 | 9.0 | 9.0 | 9.2 | 8.5 | 9.1 |
| Amount of remaining sulfite ion (potassium sulfite etc.) (g/l) | 0 | 8.8 | 2.5 | 1.3 | 2.0 | 1.8 | 2.7 | 1.1 | 2.5 |
| Amount of remaining 5-nitroindazole (mg/l) | 63 | 154 | 112 | 105 | 95 | 146 | 140 | 143 | 143 |
| Fog | 0.04 | 0.01 | 0.03 | 0.03 | 0.05 | 0.01 | 0.01 | 0.01 | 0.01 |
| $\bar{G}$ | 2.07 | 2.50 | 2.23 | 2.27 | 1.98 | 2.31 | 2.29 | 2.30 | 2.32 |
| Relative sensitivity | 90 | 67 | 76 | 88 | 80 | 86 | 88 | 85 | 89 |
| $D_m$ | 3.15 | 3.15 | 3.16 | 3.18 | 3.20 | 3.22 | 3.21 | 3.18 | 3.22 |
| $Ca^{++}$ chelating ability | X | | | | X | | | | |
| Remarks | | | Comparison | | | | Invention | | |

TABLE 3

| Developer | 10 | 11 | 12 | 13 | 14 | 15 | 16 | 17 | 18 |
|---|---|---|---|---|---|---|---|---|---|
| Chelating agent | — | EDTA | EDTA—OH | PBTC | SSA | DTPA | TTHA | EDTP | TTHA EDTA |
| Amount of remaining hydroquinone (g/l) | 9.0 | 1.8 | 4.5 | 9.4 | 9.6 | 9.8 | 9.5 | 9.2 | 9.3 |
| Amount of remaining sulfite ion (potassium sulfite etc.) (g/l) | 9.9 | 18.5 | 11.8 | 10.3 | 12.3 | 12.1 | 11.7 | 11.5 | 11.5 |
| Amount of remaining 5-nitroindazole (mg/l) | 70 | 157 | 109 | 103 | 90 | 151 | 148 | 147 | 150 |
| Fog | 0.04 | 0.02 | 0.03 | 0.03 | 0.05 | 0.01 | 0.01 | 0.01 | 0.01 |
| $\overline{G}$ | 2.07 | 2.56 | 2.36 | 2.43 | 2.21 | 2.58 | 2.59 | 2.56 | 2.57 |
| Relative sensitivity | 90 | 70 | 81 | 91 | 86 | 90 | 91 | 89 | 91 |
| $D_m$ | 3.38 | 3.40 | 3.36 | 3.39 | 3.38 | 3.44 | 3.42 | 3.43 | 3.45 |
| $Ca^{++}$ chelating ability | X | | | | X | | | | |
| Remarks | | | Comparison | | | | Invention | | |

The chelating aagents indicated in Tables 2 and were as follows:

EDTA: ethylenediaminetetraacetic acid

EDTA-OH: ethylenediaminemonohydroxyethyltriacetic acid

PBTC: 2-phosphonobutane-1,2,4-tricarboxylic acid

SSA: sulfosalicylic acid

DTPA: diethylenetriaminepentaacetic acid

TTHA: triethylenetetraminehexaacetic acid

EDTP: ethylenediaminetetramethylenephosphonic acid

In developer Nos. 9 and 18, the TTHA and EDTA were used in a concentration of $2\times10^{-3}$ mole and $1\times10^{-3}$ mole, respectively.

The following conclusions can be drawn from the results set forth in Table 2.

In developer No. 1, containing no chelating agent, the sulfite ion is consumed and the antifoggant decreases. As a result, fog increases and the contrast decreases. With EDTA most generally used heretofore (developer No. 2), the stability of hydroquinone is very poor, and the relative sensitivity decreases markedly. With other chelating agents (developer Nos. 3 to 5), the stabilily of hydroquinone is not sufficient or the stability of the antifoggant is not sufficient. As a result, the fog increases, the sensitivity is lowered, or the contrast is reduced.

In contrast, when developer Nos. 6 to 9 containing the chelating agent of this invention are used, the stability of hydroquinone is markedly increased, and the stability of the antifoggant in accordance with this invention is not reduced. It is thus possible to inhibit fog and prevent sensitivity reduction or contrast reduction.

The use of the chelating agent in accordance with this invention can effectively prevent the formation of a precipitate in the developer.

Some chelating agents intended to increase the stability of a developer have been proposed heretofore. A developer containing a dialdehyde-type hardener and the organic antifoggant in accordance with this invention for silver halide photographic material is complex, and it is impossible to anticipate which of the conventional chelating agents can be suitably used, and limited chelating agents should be selected.

It can be seen from the results of Table 3, however, that if the amount of the sulfite is increased (namely the ratio of the sulfite and bisulfite to hydroquinone is increased, $\overline{G}$ and $D_{max}$ increase and more favorable photographic properties can be maintained.

It is seen from Table 2 that even when the selected chelating agent of this invention is used, the stability of the sulfite is rather reduced, although the stability of hydroquinone is higher than in the case of using EDTA. This effect of the chelating agent could not at all be anticipated, and the significance of increasing the sulfite/hydroquinone ratio presumably resides in this sense.

In any case, the stability of the developer for photographic materials as in this invention cannot be increased by simply replacing the known chelating agent.

EXAMPLE 2

The same radiographic material as used in Example 1 was exposed, and processed as follows in a roller conveying-type small-sized automatic developer (Model RK made by Fuji Photo Film Co., Ltd.).

To each of the developer replenishers shown in Table 4 were added 10 g/liter of sodium bromide and 1.6 ml/liter of glacial acetic acid as starters, and the resulting mixture was used as a developer in the above automatic developing machine.

Each of the replenishers shown in Table 4 was supplied in an amount of 60 ml per 10 inches×12 inches of the photographic material.

19 liters of the replenisher was prepared first, and 7 liters of it was used together with the starters in the automatic developing machine, and the processing was started. When the replenisher was used up, 19 liters of the replenisher was newly prepared.

Fuji F (made by Fuji Photo Film Co., Ltd.) was used as the fixing solution. The fixing solution was replenished in an amount of 90 ml per 10 inches×12 inches of the photographic material.

| The processing step was as follows: | | |
|---|---|---|
| Development | 35° C. | 24 seconds |
| Fixation | 30° C. | 24 seconds |
| Washing | 18° C. | 63 seconds |
| Squeezing | — | |
| Drying | 50–55° C. | 19 seconds |
| Total | | 130 seconds |

The automatic processor was operated for 6 days a week, and on the day of operation, it was made ready for action for 10 hours. Fifteen photographic materials (10 inches×12 inches) half-exposed were processed per day.

The experiment conducted as above was carried out. At the end of 15 days when 19 liters of the first replenisher was used up, and at the end of 39 days when the second replenisher was used up, the photographic properties and changes in the main components and the pH in the automatic processing tank were examined, and the results are shown in Table 5.

The degree of coloration of the developer was evaluated by measuring the absorbance of the developer at a wavelength of 450 nm.

In Table 5, Fog stands for fogging, $\overline{G}$ stands for gradient, and Sens stands for relative sensitivity. The sensitivity is a relative value obtained by taking the sensitivity obtained at the start of processing with developer No. 1 as 100. Dm represents a maximum density.

TABLE 4

| | Developer Replenisher No. | | | | | |
|---|---|---|---|---|---|---|
| | 1 | 2 | 3 | 4 | 5 | 6 |
| Chelating agent | EDTA $3 \times 10^{-3}$ mol | EDTA—OH $3 \times 10^{-3}$ mol | DTPA $3 \times 10^{-3}$ mol | DTPA $3 \times 10^{-3}$ mol | DTPA $3 \times 10^{-3}$ mol | DTPA $3 \times 10^{-3}$ mol |
| Potassium hydroxide | 29.0 g | 29.0 g | 29.0 g | 29.0 g | 29.0 g | 29.0 g |
| Potassium sulfite | 44.2 g | 44.2 g | 44.2 g | 49.2 g | 54.2 g | 59.2 g |
| Potassium metabisulfite | 12.6 g | 12.6 g | 12.6 g | 12.6 g | 12.6 g | 12.6 g |
| Sodium bicarbonate | 7.5 g | 7.5 g | 7.5 g | 7.5 g | 7.5 g | 7.5 g |
| Boric acid | 3 g | 3 g | 3 g | 3 g | 3 g | 3 g |
| Diethylene glycol | 20 ml | 20 ml | 20 ml | 20 ml | 20 ml | 20 ml |
| 5-Methylbenzotriazole | 0.06 g | 0.06 g | 0.06 g | 0.06 g | 0.06 g | 0.06 g |
| 5-Nitroindazole | 0.2 g | 0.2 g | 0.2 g | 0.2 g | 0.2 g | 0.2 g |
| Hydroquinone | 30 g | 30 g | 30 g | 30 g | 30 g | 30 g |
| 1-Phenyl-3-pyrazolidone | 1.5 g | 1.5 g | 1.5 g | 1.5 g | 1.5 g | 1.5 g |
| Glutaraldehyde | 5 g | 5 g | 5 g | 5 g | 5 g | 5 g |
| Acetic acid | in an amount to adjust pH to 10.30 | | | | | |
| molar ratio of (sulfite + bisulfite) to hydroquinone | 1.497 | 1.497 | 1.497 | 1.613 | 1.729 | 1.845 |

TABLE 5

| | | Developer No. | | | | | |
|---|---|---|---|---|---|---|---|
| | | 1 | 2 | 3 | 4 | 5 | 6 |
| At the start | Fog | 0.03 | 0.03 | 0.02 | 0.02 | 0.03 | 0.02 |
| | $\overline{G}$ | 2.51 | 2.48 | 2.53 | 2.50 | 2.52 | 2.55 |
| | Sens | 100 | 99 | 100 | 101 | 100 | 101 |
| | Dm | 3.35 | 3.32 | 3.35 | 3.38 | 3.41 | 3.45 |
| 15 days later | Fog | 0.03 | 0.04 | 0.03 | 0.03 | 0.04 | 0.03 |
| | $\overline{G}$ | 2.41 | 2.43 | 2.51 | 2.52 | 2.54 | 2.58 |
| | Sens | 95 | 97 | 96 | 97 | 101 | 101 |
| | Dm | 3.40 | 3.38 | 3.40 | 3.40 | 3.45 | 3.48 |
| 39 days later | Fog | 0.04 | 0.04 | 0.04 | 0.03 | 0.03 | 0.03 |
| | $\overline{G}$ | 2.03 | 2.21 | 2.28 | 2.37 | 2.51 | 2.55 |
| | Sens | 57 | 81 | 85 | 89 | 100 | 102 |
| | Dm | 2.61 | 2.81 | 3.10 | 3.25 | 3.47 | 3.45 |
| 15 days later | Hydroquinone (g) | 16 | 19.5 | 21.4 | 21.8 | 21.9 | 22.2 |
| | 5-Nitroindazole (mg) | 132 | 115 | 134 | 133 | 136 | 132 |
| | Degree of coloration | 0.38 | 0.35 | 0.34 | 0.22 | 0.16 | 0.15 |
| 39 days later | Hydroquinone (g) | 6 | 12.1 | 15.2 | 15.3 | 15.8 | 16.1 |
| | 5-Nitroindazole (mg) | 130 | 98 | 131 | 134 | 133 | 135 |
| | Degree of coloration | 0.82 | 0.43 | 0.39 | 0.26 | 0.18 | 0.17 |
| | | Comparison | | | Invention | | |

It is seen from the above results that even when the number of photographic materials processed is small and the rate of exchanging the developer is slow, the use of the developers in accordance with this invention (developer Nos. 3 to 6) can maintain hydroquinone at a high level without deteriorating the organic antifoggant, and provide very stable photographic properties.

As the ratio of the sulfite and bisulfite increases, the photographic properties can be further stabilized and the coloration of the developers is reduced markedly (developer Nos. 4 to 6).

While the invention has been described in detail and with reference to specific embodiments thereof, it will be apparent to one skilled in the art that various changes and modifications can be made therein without departing from the spirit and scope thereof.

What is claimed is:

1. A method for development processing an imagewise exposed silver halide photographic material, comprising developing said material with an alkaline black-and-white developer comprising (1) hydroquinone, (2) a 3-pyrazolidone developing agent, (3) a dialdehyde hardener, (4) at least one antifoggant selected from the group consisting of indazole antifoggants, benzimidazole antifoggants and benzotriazole antifoggants, and (5) at least one chelating agent selected from the group consisting of diethylenetriaminepentaacetic acid, triethylenetetraminehexaacetic acid, and alkali metal salts of said acids, wherein the developer further contains a sulfite, a bisulfite, or a combination thereof, and the molar ratio of the sulfite and bisulfite to hydroquinone is at least about 1.6/1.

2. A method as in claim 1, wherein the developer contains a sulfite, a bisulfite, or a combination thereof, and the molar ratio of the sulfite and bisulfite to hydroquinone is from about 1.6/1 to about 3.5/1.

3. A method as in claim 1, wherein the developer contains a sulfite, a bisulfite, or a combination thereof, and the molar ratio of the sulfite and bisulfite to hydroquinone is from about 1.65/1 to about 2.8/1.

4. A method as in claim 1, wherein the amount of the chelating agent is from $1 \times 10^{-4}$ to $1 \times 10^{-1}$ mole per liter of the developer.

5. A method as in claim 2, wherein the amount of the chelating agent is from $1 \times 10^{-3}$ to $1 \times 10^{-2}$ mole per liter of the developer.

6. A method as in claim 4, wherein the hydroquinone is present in the developer in an amount of from 15 g to 35 g per liter, the 3-pyrazolidone developing agent is present in an amount of from 0.5 g to 2 g per liter, the dialdehyde hardener is present in an amount of from 3 g to 10 g per liter, and the amount of the antifoggant is from 0.1 to 2 mmoles per liter of the developer.

7. A method as in claim 5, wherein the hydroquinone is present in the developer in an amount of from 15 g to 35 g per liter, the 3-pyrazolidone developing agent is present in an amount of from 0.5 g to 2 g per liter, the dialdehyde hardener is present in an amount of from 3 g to 10 g per liter, and the amount of the antifoggant is from 0.1 to 2 mmoles per liter of the developer.

8. A method as in claim 1, wherein the silver halide photographic material is a radiographic silver halide photographic material.

* * * * *